United States Patent [19]

Smith

[11] Patent Number: 5,068,931

[45] Date of Patent: Dec. 3, 1991

[54] APPARATUS FOR LIFTING AND TURNING A PATIENT CONFINED TO A BED

[76] Inventor: Gene A. Smith, P.O. Box 179, Shallotte, N.C. 28459

[21] Appl. No.: 718,971

[22] Filed: Jun. 21, 1991

[51] Int. Cl.[5] ..... A61G 7/10

[52] U.S. Cl. ..... 5/84; 5/85; 5/86; 5/88; 5/61

[58] Field of Search ..... 5/88, 85, 84, 83, 61, 5/65, 81 R, 86

[56] References Cited

U.S. PATENT DOCUMENTS

| | | | |
|---|---|---|---|
| 545,741 | 9/1895 | Shutters | 5/88 |
| 680,814 | 8/1901 | Smith . | |
| 775,520 | 11/1904 | Crigler | 5/83 |
| 904,587 | 11/1908 | Wible . | |
| 1,227,301 | 5/1917 | Ogden | 5/85 |
| 1,263,611 | 4/1918 | Scroggin | 5/88 |
| 1,301,284 | 4/1919 | Ledan | 5/84 |
| 1,588,573 | 6/1926 | Edmiston | 5/84 |
| 1,968,477 | 7/1934 | Cole | 5/85 |
| 2,035,116 | 3/1936 | Elmick | 5/85 |
| 2,100,663 | 11/1937 | Maddox | 5/85 |
| 2,283,511 | 5/1942 | Sellers et al. | 5/88 |
| 2,603,851 | 7/1952 | Hawkins | 5/85 |
| 2,629,108 | 2/1953 | Wickey | 5/84 |
| 3,383,717 | 5/1968 | Underwood | 5/88 |

FOREIGN PATENT DOCUMENTS

| | | | |
|---|---|---|---|
| 4795 | of 1914 | United Kingdom | 5/84 |

*Primary Examiner*—Alexander Grosz

*Attorney, Agent, or Firm*—W. Thad Adams, III

[57] ABSTRACT

An invalid patient lifting and turning apparatus which includes an open framework for being positioned above a bed, an elevator supported by the open framework and a patient support straps for being positioned on a mattress of the bed underneath the patient and remaining underneath the patient at all times. The straps are removable and replaceable for extending laterally from side-to-side along the length of the patient for supporting the patient's head, trunk and legs. Connecting straps are provided for connecting the patient support straps and the elevator thereby permitting the patient support straps to lift the patient above the mattress surface for cleaning and bed-linen changing. A patient turning apparatus is provided for being connected to the elevator for turning the patient from side-to-side in the bed.

14 Claims, 6 Drawing Sheets

APPARATUS FOR LIFTING AND TURNING A PATIENT CONFINED TO A BED

TECHNICAL FIELD AND BACKGROUND OF THE INVENTION

This invention relates to an apparatus and method for lifting and turning a patient confined to a bed. The ability to easily lift and turn a patient permits the patient to be easily bathed, dressed and undressed, exercised and otherwise cared for in ways which are difficult or impossible when the patient cannot be removed from the bed and therefore must be moved around on the surface of the bed. The ability to lift and suspend the patient above the surface of the bed permits easy and frequent changes of bed linens. These features substantially reduce staff labor and the amount of time required to properly and compassionately attend to a patient's physical and sanitary needs, reduce odors, skin infections and bed sores, and substantially improves the overall level of care which can be provided.

The apparatus according to the invention is equally adaptable for use in hospitals, nursing homes and in the patient's own home. In fact, the ease with which the patient can be cared for using the apparatus and method of the invention permits many patients to be cared for by their family at home, rather than being confined to a nursing home or hospital.

Typical procedures used to care for bedridden patients require that the patient be physically moved about on the surface of the bed. For example, care for incontinent patients typically requires that the patient be physically rolled or turned onto one side of the bed. The patient is held in that position manually or with a pillow wedged under the back while the draw sheet, plastic sheet and cloth sheet and even perhaps the mattress pad is removed from that side of the bed and placed next to the patient. Then, fresh bed linens are placed and arranged on the bare side of the bed. The patient is then manually rolled over the dirty linen onto the newly made side of the bed with the fresh linen, while the soiled side of the bed on which the patient was lying is changed. The soiled linen is removed and the clean linen already on the other side is pulled across the bed and arranged. Then, the patient is rolled to the center of the bed. If care is not taken, moving the patient back and forth on the bed while changing the bed linens can re-soil the freshly applied linens if the patient's clothes are themselves soiled—a condition which is very common.

Bathing patients is also quite difficult while the patient is lying on the bed. Many areas of the body are difficult to reach and properly clean unless the patient is turned or rolled. Constant contact between the patient and the bed almost insures re-soiling of either the patient or the bed linens since both cannot be cleaned at the same time.

Bedsores and poor blood circulation are common ailments of invalid patients. For this reason, good medical practice requires that a patient be rolled or turned from side-to-side periodically to relieve pressure on particular joints and muscles, and to vary the circulation pattern and permit free circulation to all parts of the body. Since invalid patients can suffocate if rolled over onto their stomach for any period of time, the patient is merely rolled partially so that the patient is lies flat on the back, then on towards one side, then the other side in alternating sequence, the patient being supported by a pillow against the side and under the back. This requires repeated physical labor by the person caring for the patient. Because of the difficulty of doing this, and staff shortages, patients very often are not turned as often as good medical practice requires.

This procedure is time-consuming and requires substantial physical labor. The amount of labor often requires that two or more persons carry out the steps described above. This often makes it impossible for a patient to be cared for at home even though the condition of the patient is otherwise acceptable for home care. This causes substantial additional health care costs, overcrowding and staff shortages. A recognized cause of the difficulty in hiring non-professional hospital and nursing home staff is the objection many otherwise willing and qualified staff have to the amount of physical labor required to attend to the sanitary needs of bedridden patients.

It is also documented that one of the significant causes of workers compensation claims and on-the-job injuries in hospitals and nursing homes are strains, muscle pulls and the like resulting from the continuous practice of the procedures described above.

The apparatus and method of the invention were conceived and developed as the result of a husband's desire to care for his invalid wife at home, and the unavailability of any apparatus to assist in caring for the wife's sanitary needs.

SUMMARY OF THE INVENTION

Therefore, it is an object of the invention to provide an apparatus which permits a bedridden patient to be lifted and suspended above the bed while the bed linens are changed.

It is another object of the invention to provide an apparatus which permits a bedridden patient to be bathed while suspended above the bed.

It is another object of the invention to provide an apparatus which permits a bedridden invalid patient to be turned from side-to-side while on the bed.

It is another object of the invention to provide an apparatus which can be attached to and used with a conventional type of bed.

It is another object of the invention to provide an apparatus which can be rolled from bed-to-bed or to bathing or other stations with the patient suspended thereon.

It is another object of the invention to provide an apparatus which can be rolled from bed-to-bed or to bathing or other stations while empty whereby a single apparatus can service numerous patients.

It is another object of the invention to provide an apparatus which can be integrally formed with a bed.

It is another object of the invention to provide a method of turning a patient from side-to-side while confined to an invalid bed.

It is another object of the invention to provide a method of changing bed linens of invalid bed and cleaning a patient while the patient is confined to the invalid bed.

It is another object of the invention to provide a method of attending to various parts of the patient by selective removal of the means by which the patient is suspended above the bed.

These and other objects of the present invention are achieved in the preferred embodiments disclosed below by providing an invalid patient lifting and turning apparatus which includes an open framework for being positioned above a bed, elevator means supported by the open framework, and patient support means for being positioned on a mattress of the bed underneath the patient and remaining underneath the patient at all times. The support means comprises a plurality of spaced-apart, removable and replaceable strap means for extending laterally from side-to-side along the length of the patient for supporting the patient's head, trunk and legs. Connecting means are provided for connecting the patient support means and the elevator means thereby permitting the patient support means to lift the patient above the mattress surface for cleaning and bed-linen changing. Patient turning means are provided for being connected to the elevator means for turning the patient from side-to-side in the bed.

According to one preferred embodiment of the invention, the elevator means includes first and second spaced-apart winding bars extending along the length of the framework, a motor carried by the framework, and drive means operatively interconnecting the motor and the first and second winding bars for rotating the winding bars in opposite winding and unwinding directions.

According to another preferred embodiment of the invention, the connecting means includes first and second pairs of spaced-apart elongate flexible members connected by one end to respective first and second winding bars and first and second spacing bars positioned on opposite sides of the framework and extending along the length of the framework in longitudinal alignment with the winding bars and connected to the other end of respective ones of the pairs of flexible members.

According to yet another preferred embodiment of the invention, the patient turning means includes elongate means extending diagonally from one of the winding bars laterally across the framework to the opposite side thereof; and sheet attachment means for being attached to a draw sheet extending under the patient and being pulled diagonally laterally across the bed from one side towards the opposite side of the bed.

According to one preferred embodiment of the invention, the drive means includes a drive sprocket on the motor and first and second driven sprockets positioned for rotation respectively with the first and second winding bars. An endless chain interconnects the drive sprocket and the first and second driven sprockets for transmitting rotary motion from the motor to the first and second winding bars.

According to another preferred embodiment of the invention, the drive means includes a third winding bar mounted on the framework between the first and second winding bars and extending along the length of the framework in axial alignment with the first and second winding bars, and first and second straps, each connected by one end thereof to the third winding bar and by the opposite end thereof to respective ones of the first and second winding bars. One of the first and second straps extends around the third winding bar in a clockwise direction and the other of the first and second straps extends around the third winding bar in a counterclockwise direction. Rotation of the motor in one direction winds both first and second straps onto the third winding bar and rotation in the other direction unwinds both the first and second straps off of the third winding bar.

According to yet another preferred embodiment of the invention, the sheet attachment means comprises a bar for being passed through a loop in the draw sheet and attached to the elongate means.

According to yet another preferred embodiment of the invention the elongate means comprises a strap.

An embodiment of the method according to the invention, a method of turning a patient confined to a bed comprises the steps of positioning patient support means laterally across the bed from one side to the other between the bed mattress and the patient, connecting the patient support means on one side of the bed to elongate connecting means extending diagonally and laterally across the bed from a position above the bed and on the side of the patient opposite from the side where the connecting means are attached to the patient support means, and retracting the connecting means diagonally and laterally upwardly away from the patient to pull the support means against the patient whereby the patient is turned.

Another embodiment according to the invention comprises a method of changing bed linens of an invalid bed and cleaning a patient while the patient is confined to the invalid bed, and comprising the steps of positioning patient support means laterally across the bed from one side to the other between the bed mattress and the patient in direct contact with the patient, lifting the patient support means and the patient thereon to a suspended position in spaced-apart relation to the upper surface of the bed and holding the patient in the suspended position while removing the soiled bed linen and replacing it with clean bed linen and cleaning the patient. Then the cleaned patient is lowered onto the freshly made bed.

Preferably, the patient support means comprises a first plurality of strap members extending laterally from side-to-side in spaced-apart relation along the length of the patient for supporting the patient's head, trunk and legs. The method preferably includes the steps of providing a second plurality of strap members, placing one of the second plurality of strap members in place adjacent one of the first plurality of strap members while the patient is in the suspended position and removing the adjacent one of the first plurality of strap members while the patient is in the suspended position and repeating above steps until all or at least the soiled ones of the first plurality of strap members have been replaced with the second plurality of strap members.

According to one preferred embodiment of the invention, the method includes the step of removing the strap member supporting the patient's head while the patient is in the suspended position in order to wash the patients hair.

According to one preferred embodiment of the invention, the method includes the step of removing the strap member supporting the patient's lower legs in order to bathe the feet or permit exercise or massage of the lower legs and feet.

Preferably, the support means comprise straps having a soft, thick intermediate portion for being positioned under the patient and opposing end portions having fastening means for permitting the straps to fastened to elevator means used to lift and suspend the patient.

Preferably, the intermediate portion comprises lamb or sheep wool and the fastening means comprises cooperating male and female hook and loop fastener components.

BRIEF DESCRIPTION OF THE DRAWINGS

Some of the objects of the invention have been set forth above. Other objects and advantages of the invention will appear as the invention proceeds when taken in conjunction with the following drawings, in which.

Figure 1:
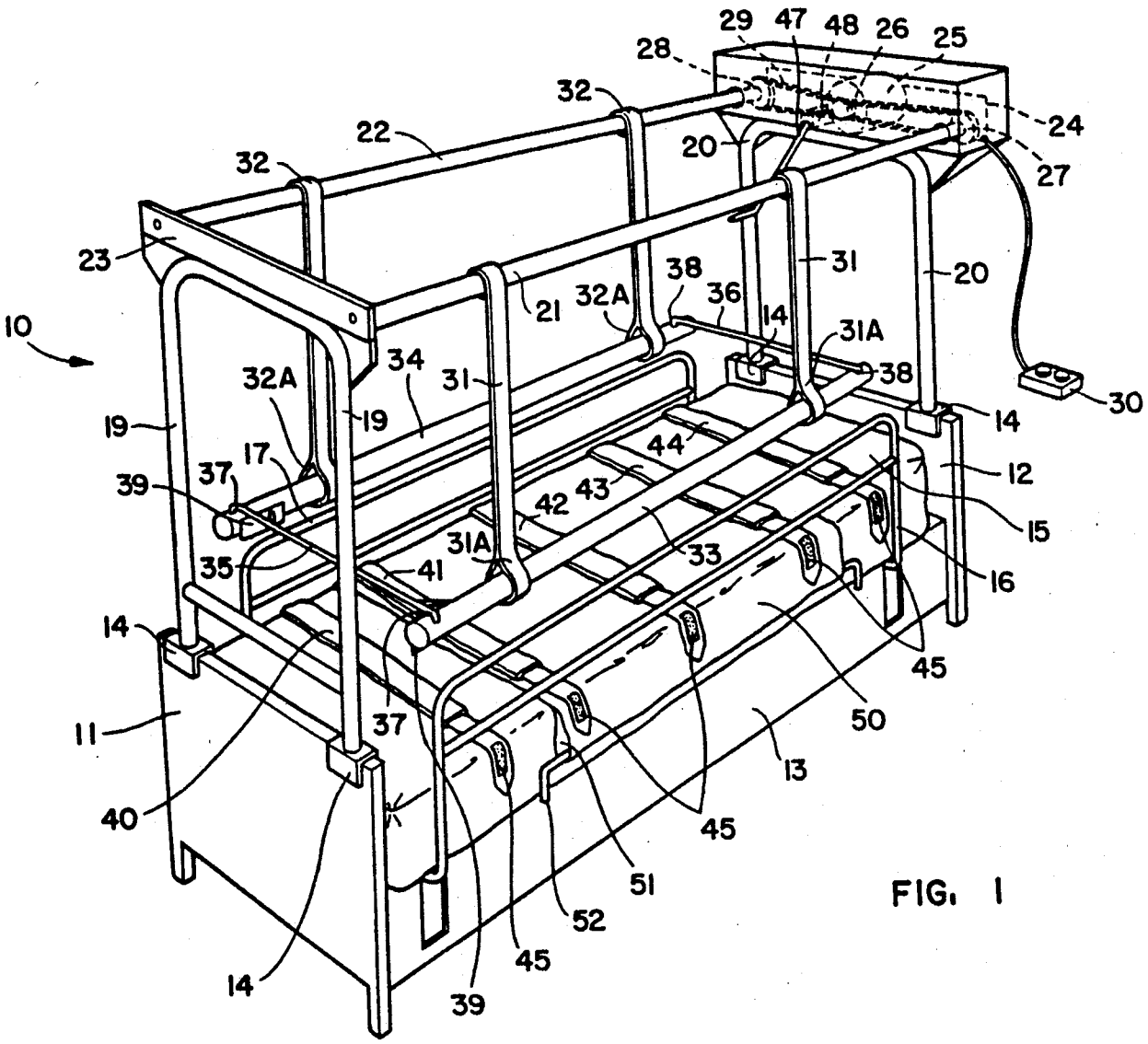
FIG. 1 is a perspective view of an apparatus for lifting and turning an invalid patient positioned on a hospital bed.

DESCRIPTION OF THE PREFERRED EMBODIMENT AND BEST MODE DESCRIPTION OF APPARATUS—FIG. 1

Referring now specifically to the drawings, an apparatus for lifting and turning a patient according to the present invention is illustrated in FIG. 1 and shown generally at reference numeral 10. Apparatus 10 is shown mounted on the footboard 11 and headboard 12 of a hospital bed 13 by brackets 14 which are positioned on the top edge of the footboard 11 and headboard 12. Brackets 14 may be attached by bolts, clamps or by other suitable means. Bed 13 includes a mattress 15 and vertically adjustable side rails 16 and 17.

Apparatus 10 is comprised of on open framework which includes upright foot and head standards 19, 20 to which the brackets 14 are secured. Winding bars 21 and 22 are mounted in suitable bearings (not shown) and are carried by winding bar supports 23, 24. Winding bars 21 and 22 are driven by a motor and gear reduction unit 25 mounted on winding bar support 24. Motor and gear reduction unit 25 has a drive sprocket 26 which drives driven sprockets 27 and 28 concentrically mounted on winding bars 21 and 22, respectively by means of a sprocket chain 29. In the preferred embodiment a 1650 rpm, 1/6 hp reversible duty single phase motor is reduced through a 40 to 1 gear reduction unit. The diameter and teeth of the gearing are selected to provide 11 rpm for the winding bars 21 and 22. Of course, many other combinations of motor sizes, powers and drive arrangements are usable with suitable adjustments in gearing. A control box 30 controls operation, of the motor 25 and therefore the motion of the winding bars 21 and 22.

Connecting means comprising first and second pairs of straps 31, 32 are wound onto winding bars 21 and 22 and secured by bolts (not shown) or by similar means. Both pairs of straps 31, 32 are wound in a counterclockwise direction since motor 25 rotates gears 27 and 28 in the same direction. The other end of pairs of straps 31 and 32 are formed into loops 31A, 32A. These loops 31A, 32A receive and support respective spacing bars 33 and 34. Normally, spacing bars 33 and 34 are positioned at or just slightly above the upper surface of mattress 15. Spacing bars 33 and 34 are shown in a slightly elevated position in FIG. 1.

Spacing bars 33 and 34 are maintained in the correct alignment and spacing with each other by means of braces 35 and 36. Brace 35 is positioned in holes 37 in the upper side of one foot end of spacing bars 33 and 34, and includes side braces 39 which keep spacing bars 33 and 34 parallel with the winding bars 21 and 22. Brace 36 is positioned in holes 38 in the upper side of the head end of spacing bars 33 and 34.

Patient support means comprise a plurality of thick lambswool covered support straps—in FIG. 1 five such straps 40–44 are 15 shown. Either more or fewer straps may be used depending on the size and weight of the patient, the width of the straps and similar factors. Each end of the straps 40–44 have complementary male and female hook and loop fasteners 45 (only the male is shown) by which the support straps 40–44 are securely fastened to spacing bars 33 and 34. As is shown in FIG. 1, the support straps 40–44 are laterally, i.e., side-to-side, positioned in spaced-apart relation along the length of the mattress 15. The spacing as well as the number of support straps 40–44 is determined by the size of the patient and the width of the support straps 40–44. Typically, five support straps will be used for a normal sized adult patient—one each for the head/neck; upper torso, lower torso/buttocks, upper legs and lower legs/feet. The support straps 40–44 are positioned directly beneath the patient, not below the bed sheet, draw sheet or other bed coverings. The thick lambswool padding on the support straps 40–44 prevents irritation and, in fact, is more comfortable for the patient than lying flat on the bed 13 without the support straps 40–44. Once all of the support straps 40–44 are fastened to the spacing bars 33 and 34, the patient can be lifted by activating motor and gear reduction unit 25 through use of the control box 30. A height detection finger 47 connected to a limit switch shuts 48 off motor and gear reduction unit 25 when contacted by brace 36 to prevent the patient from being lifted too high. Normally, the patient would never need to be lifted more than about 12–15 inches off of the surface of mattress 15.

Patient turning means are also provided, and comprise a draw sheet 50 centered laterally across bed 13. Draw sheet 50 includes a folded loop 51 in each side of the draw sheet 50 into which and through which is positioned a sheet attachment bar 52.

DESCRIPTION OF APPARATUS—FIG. 8

Figure 8:
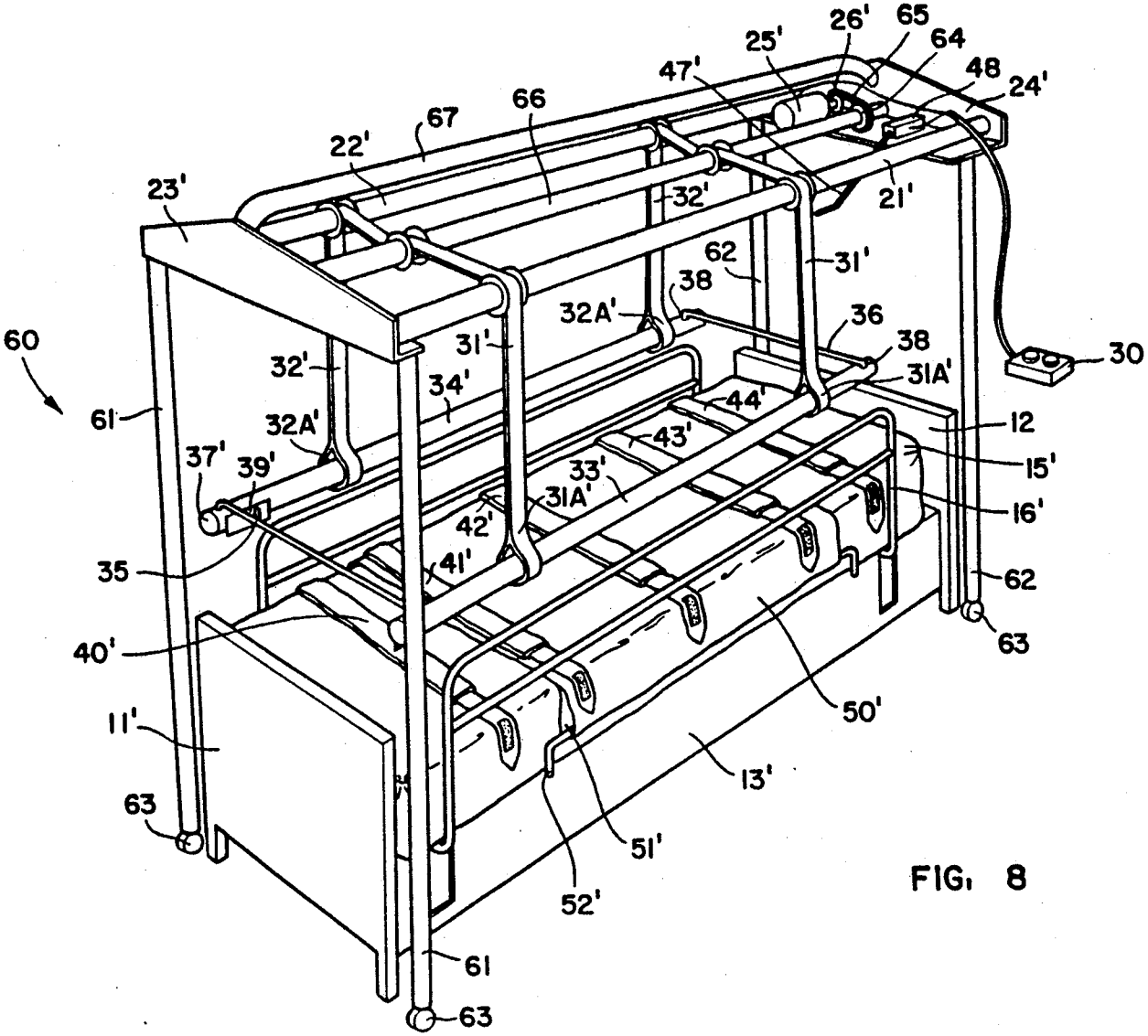
FIG. 8 is a perspective view of an alternative embodiment of an apparatus for lifting and turning an invalid patient which is adapted to be moved from bed-to-bed.

Referring now to FIG. 8, an apparatus for lifting and turning a patient according to another embodiment of the present invention is illustrated in FIG. 8 and shown generally at reference numeral 60. In the text which follows, elements which have counterparts in the description of apparatus 10 are identified with the same reference numerals.

Apparatus 60 is a portable unit which can be moved from bed-to-bed, or which can be used to transport patient from one bed to another or to other facilities. Apparatus 60 is comprised of an open framework which includes upright foot and head standards 61, 62 which are mounted on caster wheels 63. Standards 61 and 62 are spaced apart sufficiently wide to permit apparatus 60 to be positioned over a bed 13' by rolling it over the bed from one side. Alternatively, an apparatus could be sized to permit it to be rolled over the bed 13' from the front or rear. Bed 13' includes a footboard 11', a headboard 12' mattress 15' and vertically adjustable side rails 16' and 17'.

Winding bars 21', 22' which are stationary, and center winding bar 66, which is mounted in suitable bearings (not shown) and are carried by winding bar supports 23' and 24'. Center winding bar 66 is centrally mounted and is driven by motor and gear reduction unit 25' and in turn drives winding bars 21' and 22'. Motor and gear reduction unit 25' has a drive sprocket 26' which drives a driven sprocket 64 by means of a sprocket chain 65. Sprocket 64 is mounted on the end of the centrally mounted winding bar 66 for rotation therewith.

A winding bar support brace 67 is secured to winding bar supports 23', 24' by opposite ends and extends the length of the apparatus 60 in order to provide greater stability.

In the preferred embodiment a 1650 rpm, 1/6 hp reversible duty single phase motor is reduced through a 40 to 1 gear reduction unit. The diameter and teeth of the gearing are selected to provide 11 rpm for the winding bar 66. Of course, many other combinations of motor sizes, powers and drive arrangements are usable with suitable adjustments in gearing.

A control box 30' controls operation of the motor and gear reduction unit 25' and therefore the motion of the winding bars 21', 22' and 66.

Connecting means comprising first and second pairs of straps 31', 32' pass over the top of stationary winding bars 21' and 22', through nylon rollers, and are connected by one end to the center winding bar 66 by bolts or some equivalent means. Straps 31', 32' are each wound in a counter-clockwise direction. As is shown in FIG. 8, the straps 31' wind off of the top of center winding bar 66, while straps 32' wind off of the bottom of the center winding bar 66. As a result, operation of motor and gear reduction unit 25' winds the straps 31' and 32' in the same direction notwithstanding that the are attached to the single center winding bar 66. The other end of pairs of straps 31' and 32' are formed into loops 31A', 32A'. These loops 31A', 32A' receive and support respective spacing bars 33' and 34'. Normally, spacing bars 33' and 34' are positioned at or just slightly above the upper surface of mattress 15'. Spacing bars 33' and 34' are shown in a slightly elevated position in FIG. 1.

Spacing bars 33' and 34' are maintained in the correct alignment and spacing with each other by means of braces 35' and 36'. Brace 35' is positioned in holes 37' in the upper side of one foot end of spacing bars 33' and 34', and includes side braces 39' which keep spacing bars 33' and 34' parallel with the winding bars 21', 22' and 66. Brace 36' is positioned in holes 38' in the upper side of the head end of spacing bars 33' and 34'.

Patient support means comprise a plurality of thick lambswool covered support straps—in FIG. 8 five such straps 40'–44' are shown. Either more or fewer straps may be used depending on the size and weight of the patient, the width of the straps and similar factors. Each end of the straps 40'–44' have complementary male and female hook and loop fasteners 45' (only the male is shown) by which the support straps 40'–44' are securely fastened to spacing bars 33' and 34'.

As is shown in FIG. 8, the support straps 40'–44' are laterally, i.e., side-to-side, positioned in spaced-apart relation along the length of the mattress 15'. The spacing as well as the number of support straps 40'–44' is determined by the size of the patient and the width of the support straps 40'–44'. Typically, five support straps will be used for a normal sized adult patient—one each for the head/neck; upper torso, lower torso/buttocks, upper legs and lower legs/feet. The support straps 40'–44' are positioned directly beneath the patient, not below the bed sheet, draw sheet or other bed coverings. The thick lambswool padding on the support straps 40'–44' prevents irritation and, in fact, is more comfortable for the patient than lying flat on the bed 13' without the support straps 40'–44'. Once all of the support straps 40–44' are fastened to the spacing bars 33' and 34', the patient can be lifted by activating motor and gear reduction unit 25' through use of the control box 30'. A height detection finger 47' connected to a limit switch shuts off motor and gear reduction unit 25' when contacted by brace 36' to prevent the patient from being lifted too high. Normally, the patient would never need to be lifted more than about 12–15 inches off of the surface of mattress 15'.

Patient turning means are also provided, and comprise a draw sheet 50' centered laterally across bed 13'. Draw sheet 50' includes a folded loop 51' in each side of the draw sheet 50' into which and through which is positioned a sheet attachment bar 52'.

DESCRIPTION OF PATIENT LIFTING METHOD FIGS. 2–4 AND 9–11

Figure 11:
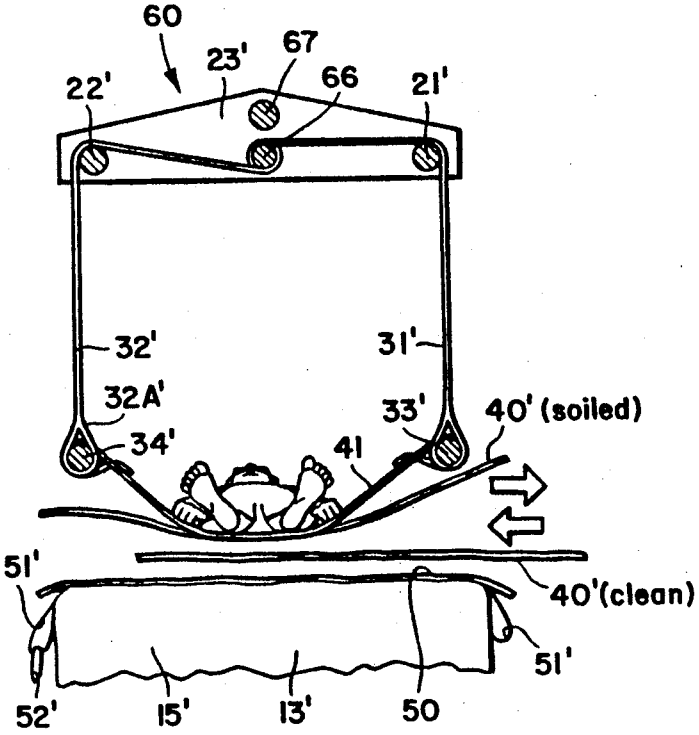
FIGS. 9, 10, and 11 are sequential views showing how bed linens are changed by suspending the patient above the bed.
Figure 10:
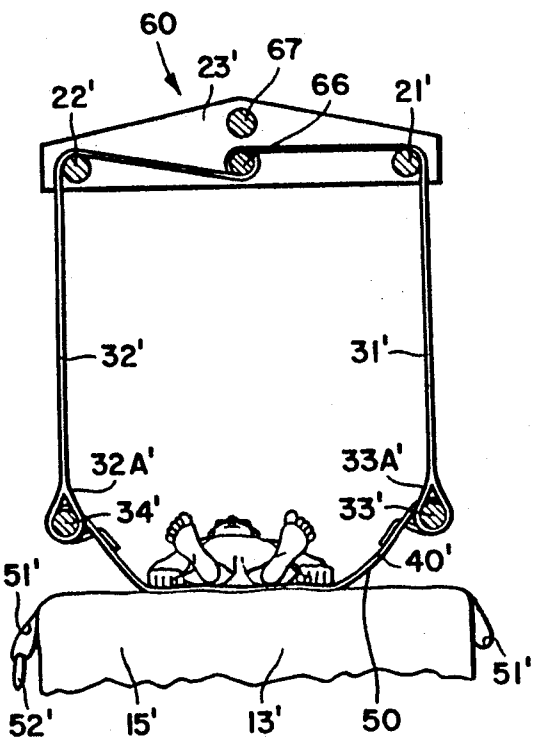
Figure 9:
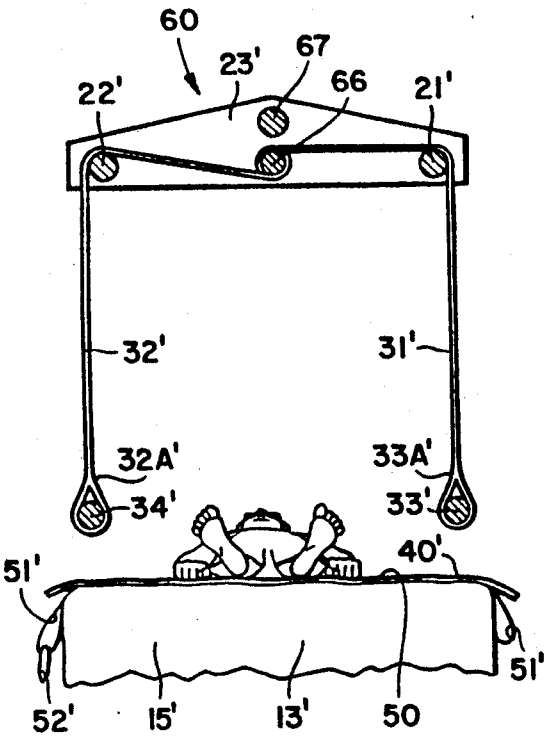

Use of the apparatus 60 permits a patient to be easily and safely lifted. Since the method is the same with either apparatus 10 or 60, it will be described with reference to Apparatus 10, it being understood the method shown in FIGS. 9–11 is also described.

Figures 2, 3, 4:
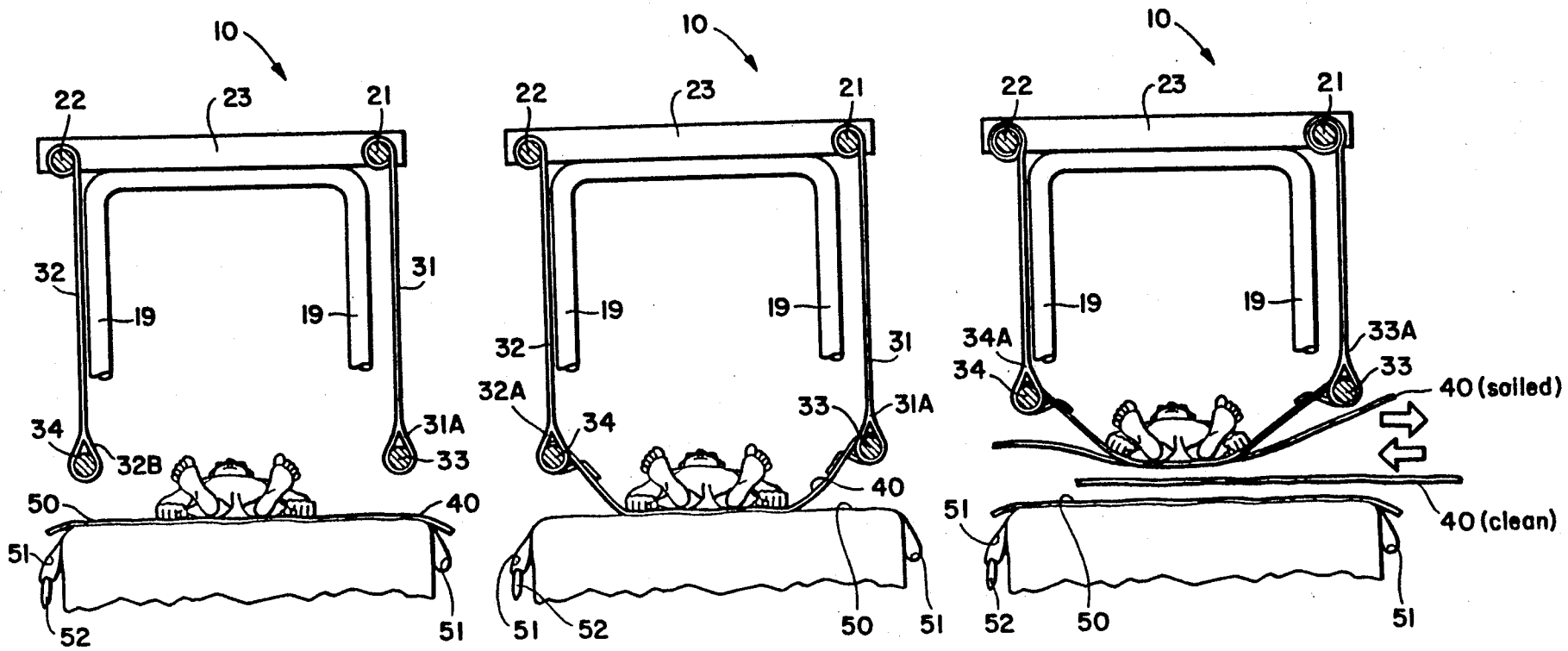
FIGS. 2, 3 and 4 are sequential views showing how bed linens are changed by suspending the patient above the bed.

As is shown in FIGS. 1 and 2, support straps 40–44 are positioned along the length of the bed 13 from side-to-side. They are attached in the manner shown in FIG. 3. With the patient lying on top of the support straps 40–44, the patient is lifted as is shown in FIG. 4. The braces 35 and 36 (not shown for clarity in FIG. 4 but shown in FIG. 1) keep spacing bars 33 and 34 in the proper spacing as is shown in FIGS. 3 and 4.

In this position, the draw sheet 50 and the other bed linens can easily removed without further moving the patient. The bed 13 is furnished with clean bed linens in a conventional manner—not in the manner used to make invalid beds. The patient can also be cleaned, undressed and dressed while in this position much more quickly and easily than when lying on the bed 13.

Very often the support straps 40–44 will themselves be soiled due to incontinence of the patient. The support straps 40–44 can be easily replaced with cleans ones by merely providing a second set of support straps 40–44. One of the straps of the second set is first attached to the spacing bars 33 and 34 directly adjacent to the one to be replaced. Then the soiled strap, for example strap 40 in FIG. 4, is detached from the spacing bars 33 and 34 and removed. This process is repeated until as many of the straps as desired have been removed and replaced. Then the soiled straps can be laundered, and used to replace the other set of straps when they become soiled.

The support straps 40–44 may be used in other ways as well. Gently removing the strap supporting the patient's head and next while the patient is suspended above the bed permits the patient's hair to be cut and/or washed and dried without wetting or dirtying the bed sheets. With the patient's head above the bed, a plastic protective sheet, basin or other protection can easily be placed under the patient's head.

Removing the strap supporting the patient's lower legs and feet permits the knee to flex and the foot to hang down. In this position the patient's legs can be exercised or massaged. The feet can be washed, the nails cut or other patient care carried out very conveniently and at a comfortable height for the patient care provider.

DESCRIPTION OF PATIENT TURNING METHOD FIGS. 5-7 AND FIGS. 12-14

Figures 5, 6, 7:
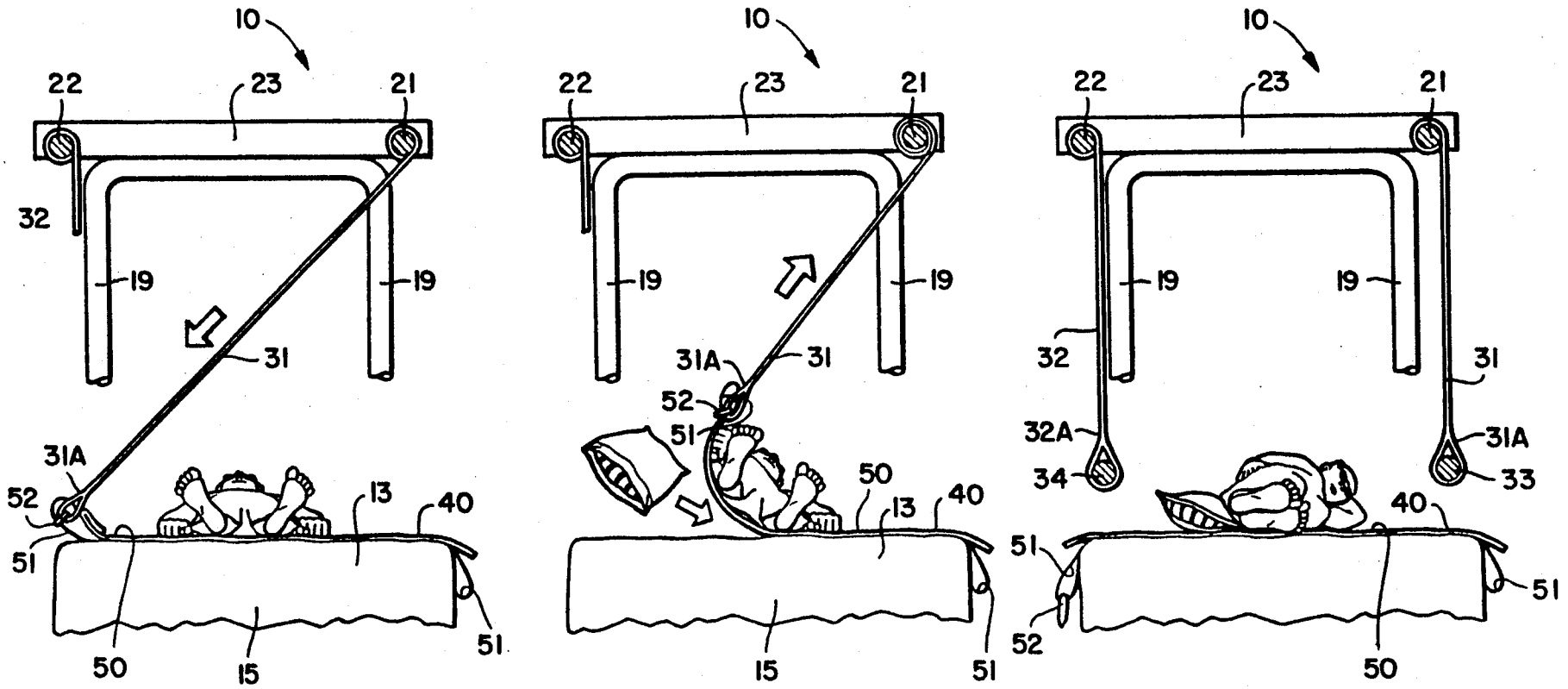
FIGS. 5, 6 and 7 are sequential views showing how an invalid patient is turned.
Figure 14:
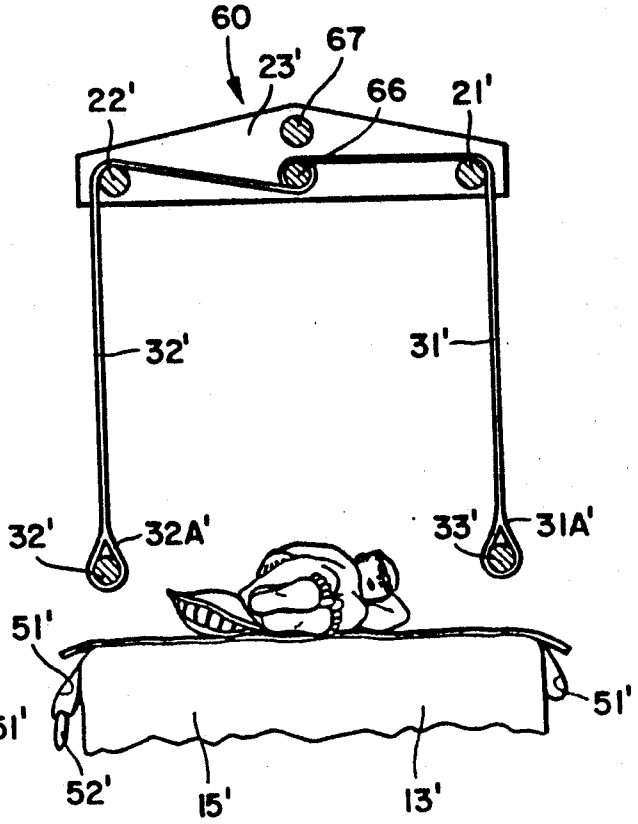
FIGS. 12, 13 and 14 are sequential views showing how an invalid patient is turned.
Figure 13:
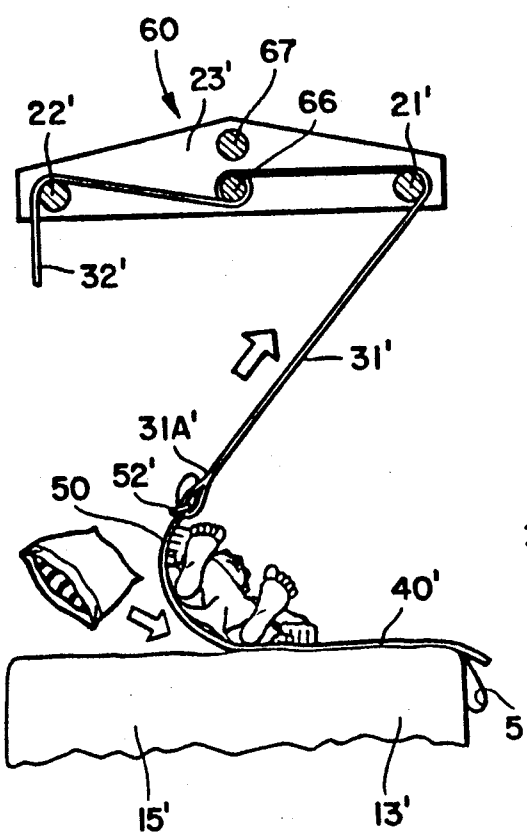
Figure 12:
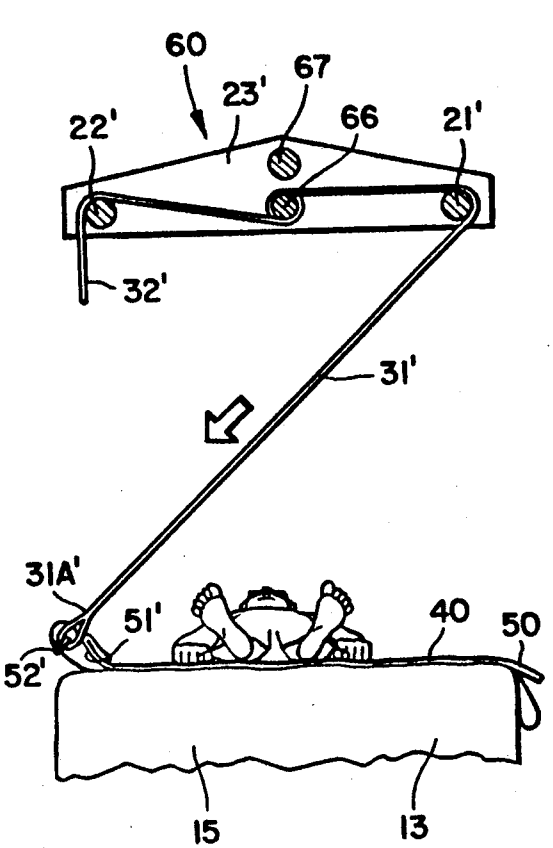

A method of turning a patient is illustrated in FIGS. 5-7 and 12-14. Since the method is the same with either apparatus 10 or 60, it will be described with reference to Apparatus 10, it being understood the method shown in FIGS. 12-14 is also described. To begin the process, spacing bar 33 is removed from strap 32 and put aside. As is shown in FIG. 5, the two straps 31 are extended laterally across the bed 13 to the other side by activating the motor 25 to provide sufficient length for the straps 31 to extend on the diagonal. The sheet attachment bar 52 is positioned in loop 51 of draw sheet 50 so that it extends out both ends. One of the straps 31 is connected to one end of the sheet attachment bar 52 and the other of the straps 31 is attached to the other end of sheet attachment bar 52. This is done by passing the opposing ends of the sheet attachment bar 52 through the loops 31A on the ends of the two straps 31. The support straps 40-44 remain in place under the patient.

With the apparatus 10 configured as described above, motor 25 is activated and the straps 31 are wound onto the winding bar 21. As is shown in FIG. 6, draw sheet 50 is pulled against the patient from the side of the bed 13 opposite the winding bar 21. As the patient is rolled, a pillow is chocked under the patient to maintain the patient in the turned position. With the patient properly turned and repositioned, straps 31 are removed from the sheet attachment bar and repositioned to support the spacing bar 33, as is shown in FIG. 7.

The patient can be turned in the opposite direction by removing spacing bar 34 from the straps 32, extending the straps 32 across the bed in the manner described above, but across the bed in the opposite direction. The sheet attachment bar 52 is placed in the loop 51 of the draw sheet 50 on the other side of the bed and the process described above is completed.

The structure of apparatus 10 and apparatus 60, including the standards, winding bars, spacing bars and winding bar supports are fabricated from stainless steel bar or tubing as required. The straps 31, 32 and 40-44 are fabricated from heavy-duty webbing of the type used for cargo slings and the like.

An apparatus for lifting and turning a patient is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An invalid patient lifting and turning apparatus, comprising:

(a) an open framework for being positioned above a bed;

(b) elevator means supported by said open framework, said elevator means including a motor and a winding bar mounted on said framework and extending along the length of the framework for being rotationally driven by said motor;

(c) winding strap means connected to said winding bar and to first and second spacing bars positioned on opposite sides of the framework;

(d) said strap means extending around said winding bar in a clockwise direction and in a counterclockwise direction whereby rotation of said motor in one direction winds said strap means onto said winding bar and rotation in the other direction unwinds said strap means off of said winding bar and thereby lowers or raises said spacing bars;

(e) patient support means for being positioned on a mattress of the bed underneath the patient and remaining underneath the patient at all times, said support means comprising a plurality of spaced-apart, removable and replaceable support strap means secured by opposite ends to said spacing bars and extending laterally from side-to-side along the length of the patient for supporting the patient's head, trunk and legs thereby permitting the strap means to lift the patient above the mattress surface for cleaning and bed-linen changing; and (f) patient turning means for being connected to said elevator means for turning the patient from side-to-side in the bed, said patient turning means including sheet attachment means for being attached to a draw sheet extending under the patient and for being pulled diagonally laterally across the bed from one side towards the opposite side of the bed by said winding strap means.

2. An invalid lifting and turning apparatus according to claim 1, wherein said winding strap means comprises first and second winding straps positioned in spaced-apart relation along the length of said winding bar.

3. An invalid lifting and turning apparatus according to claim 1, wherein said support means comprises first and second sets of straps, one of said first or second sets of straps for being substituted one strap at a time for soiled ones of the other of said first or second sets of straps while the patient is supported above the mattress surface.

4. An invalid lifting and turning apparatus according to claim 1, wherein said sheet attachment means comprises a bar for being passed through a loop in the draw sheet and attached to said winding strap means.

5. An invalid lifting and turning apparatus according to claim 1, wherein each of said support strap means comprise an elongate strap having a soft, thick intermediate portion for being positioned under the patient and opposing end portions having fastening means for permitting the straps to fastened to elevator means used to lift and suspend the patient.

6. An invalid lifting and turning apparatus according to claim 5, wherein said intermediate portion comprises lamb or sheep wool, and said fastening means comprises cooperating male and female hook and loop fastener components.

7. An invalid lifting and turning apparatus according to claim 1, wherein said sheet attachment means comprises a loop on the opposing sides of the draw sheet on opposite sides of the bed for turning the patient from one side to the other from either direction to the other direction.

8. An invalid lifting and turning apparatus according to claim 1, wherein said winding bar extends along the centerline of the apparatus from a footboard end to a headboard end of the bed, said apparatus also including first and second stationary winding bars positioned on opposing sides of said winding bar foe extending along the length of the bed from the footboard end to the headboard end of the bed in laterally spaced-apart relation to said winding bars and in respective vertically spaced-apart relation to said spacing bars, and including roller means carried by said stationary winding bars for supporting said winding strap means.

9. An invalid lifting and turning apparatus according to claim 1, and including means for rolling the apparatus from location to location and into position over a bed.

10. An invalid lifting and turning apparatus according to claim 1, and including attachment means for attaching the framework to the bed.

11. An invalid lifting and turning apparatus according to claim 10, wherein said attachment means comprises support means for supporting the framework on a bed frame of the bed.

12. An invalid lifting and turning apparatus according to claim 1, and including a first brace extending laterally between said spacing bars at one end thereof and including a second brace extending laterally between said spacing bars at the other end thereof, said braces maintaining proper alignment and spacing between said spacing bars.

13. An invalid lifting and turning apparatus according to claim 12, wherein at least one of said braces includes side braces carried by said braces and engaging said spacing bars to maintaining said spacing bars parallel with said winding bar.

14. An invalid lifting and turning apparatus according to claim 1, and including limit switch means carried by said frame and operatively connected to said motor to deactivate said motor when said limit switch is engaged, and detection means cooperating with said limit switch for detecting a predetermined maximum height of the patient above the level of the mattress of the bed and activating the limit switch.

* * * * *